US007008286B2

(12) United States Patent
Lin et al.

(10) Patent No.: US 7,008,286 B2
(45) Date of Patent: Mar. 7, 2006

(54) SPACERS MOUNTING STRUCTURE AND METHOD FOR A FIELD EMISSION DISPLAY

(75) Inventors: Wei-Yi Lin, Hsinchu (TW); Ming-Chun Hsiao, Hsinchu (TW); Ying-Hsing Chen, Hsinchu (TW); Chi-Min Tseng, Hsinchu (TW); Yun-Jiao Hsiao, Hsinchu (TW)

(73) Assignee: Industrial Technology Research Institute, Chutung Hsinchu (TW)

( * ) Notice: Subject to any disclaimer, the term of this patent is extended or adjusted under 35 U.S.C. 154(b) by 136 days.

(21) Appl. No.: 10/647,236

(22) Filed: Aug. 26, 2003

(65) Prior Publication Data

US 2004/0214504 A1 Oct. 28, 2004

(30) Foreign Application Priority Data

Apr. 22, 2003 (TW) ..... 92109418 A

(51) Int. Cl.
*H01J 19/42* (2006.01)
*H01J 9/42* (2006.01)

(52) U.S. Cl. ..... 445/66; 445/23; 313/292

(58) Field of Classification Search ..... 445/23, 445/66; 313/292, 238

See application file for complete search history.

(56) References Cited

U.S. PATENT DOCUMENTS 6,312,302 B1 * 11/2001 Na ..... 445/24
6,593,682 B1 * 7/2003 Jung et al. ..... 313/292

* cited by examiner

*Primary Examiner*—Karabi Guharay
(74) *Attorney, Agent, or Firm*—Bacon & Thomas PLLC

(57) ABSTRACT

The present invention relates to a supporting spacer mounting structure and method for a field emission display. By using a supporting spacer structure being cross-shaped or rectangle-shaped and being made of glass, ceramics or metal, and employing the vacuum adsorption of a clipping arm with special design and the real time monitoring of a monitoring lens, the position-aligning is preliminarily performed on a supporting spacer, and then the supporting spacer is positioned on a required location so as to provide the supporting force needed by a display.

7 Claims, 5 Drawing Sheets

SPACERS MOUNTING STRUCTURE AND METHOD FOR A FIELD EMISSION DISPLAY

BACKGROUND OF THE INVENTION

1. Field of the Invention

The present invention relates to spacers mounting structure and method for a field emission display. By using the clipping arm designed for the spacers and the CCD for real time monitoring, the cross-shaped or rectangle-shaped spacers will be mounted in the field emission display unit for supporting the display.

2. Description of the Prior Art

As digital technology is advancing and the internet is popular, the application of plane display are varied from portable consumer products to large-scale panel for information advertisement, even the very large-scale panel for video communication. Therefore, the general cathode ray displays are not sufficient for these applications. As the plasma display panels (PDP) with a large area and capable of emitting light automatically are merchandised and produced in a mass scale in the recent years, the technology for developing the plane displays with low cost and large area is advanced in a surprising speed. Now, the tendency is to develop the technology for the mass production of the field emission displays. Therefore, the material fields for the liquid crystal displays and the field emission displays will have more developments as the related technology advances. The materials are developed to be compound, light, thin, large, flexible, and low costing so as to promote the competition ability for the liquid crystal display and field emission display industry.

In the prior art field emission display, there are different ways to position the supporting spacers. However, there are some drawbacks in the mounting of the prior art supporting spacers. Please refer to FIG. 1. FIG. 1 is a perspective diagram of a prior art field emission display unit. The field emission display comprises a plurality of field emission display units 1, and each of the field emission display units 1 comprises a lower plate 10 and an upper plate 30. And a supporting spacer 20 is mounted between them for division fixing and supporting. As shown in FIG. 1, each of the field emission display units 1 comprises three cathode emitters 60 and three light-emitting sources 70. A cathode electrode 50 is used as a base for each of the cathode emitters 60, and the third electrode and dielectric layer device 40 is used for avoiding shorting with cathode electrodes and pulling up the electrons of the cathode emitters 60. When the cathode emitters 60 emit electrons 61 to the light-emitting sources 70, the light-emitting sources will emit the light correspondingly, and by adjusting the color series, the required color lighting points will be obtained so as to form the required color images.

Please refer to FIG. 2. FIG. 2 is a perspective diagram of a prior art supporting spacers structure. As shown in FIG. 2, the prior art supporting device 20 comprises a plurality of openings 21.

Although the supporting spacers employed in the prior art is not limited to the supporting device 20 and the opening 21 is not limited to be rectangle, in the practical application, the characteristics of the vacuum elements have to be considered when employing the supporting spacers of the field emission display so as to maintain a high air conductivity or the strength for resisting the atmosphere pressure. Therefore, a supporting spacer with a greater width-height ratio has to be obtained without affecting the frame quality of the display. This makes the employed supporting spacers in the prior art can not achieve the requirement of high resolution.

Furthermore, in the prior art supporting spacers, a mechanical arm or a clipping claw is used as the clipping portion, and this will cause the damages of the supporting spacers because of the mechanical stress.

In the prior art, a mechanical clipping device is employed in the positioning and position-aligning, and the area of the supporting spacer is excessively large. Therefore, the requirement of more precise field emission display cannot be achieved.

SUMMARY OF THE INVENTION

In order to resolve the drawbacks of the prior art, the present invention provides a supporting spacer mounting structure and method for a field emission display so as to overcome the obstacles of the technology development in the prior art. By using a cross-shaped supporting spacer or a rectangle supporting spacer structure, and mounting a supporting spacer by the vacuum absorption of a clipping arm, and using a monitoring lens for a real time monitoring, the operation of embedding the supporting spacers into the field emission display unit is accomplished.

The height of the cross-shaped or rectangle-shaped supporting spacers used in the present invention is about 0.1 centimeters, and the length of the extended arm is about 0.1 centimeters while the thickness is about 100 micrometer. Therefore, the preciseness is sufficient to achieve the requirement of high resolution for the field emission display. The employed material is glass, ceramics or metal so that the hardness of the material is capable of satisfying the need for supporting the field emission display. Besides, a clipping arm having a positioning slot is used as a mounting structure, and therefore, when performing the operation of positioning the supporting spacer, one arm of the supporting spacer is embedded into the positioning slot and then adsorption opening on the clipping arm will adsorb the supporting spacer so as to move the spacer to the required position for mounting.

Furthermore, a monitoring lens is used for monitoring the entire process of the operation so that the supporting spacer can be precisely positioned in the unit of the field emission display.

BRIEF DESCRIPTION OF THE DRAWINGS

The accompanying drawings, which are incorporated in and form part of the specification in which like numerals designate like parts, illustrate preferred embodiments of the present invention and together with the description, serve to explain the principles of the invention. In the drawings.

DETAILED DESCRIPTION OF THE PREFERRED EMBODIMENT

Figure 1:
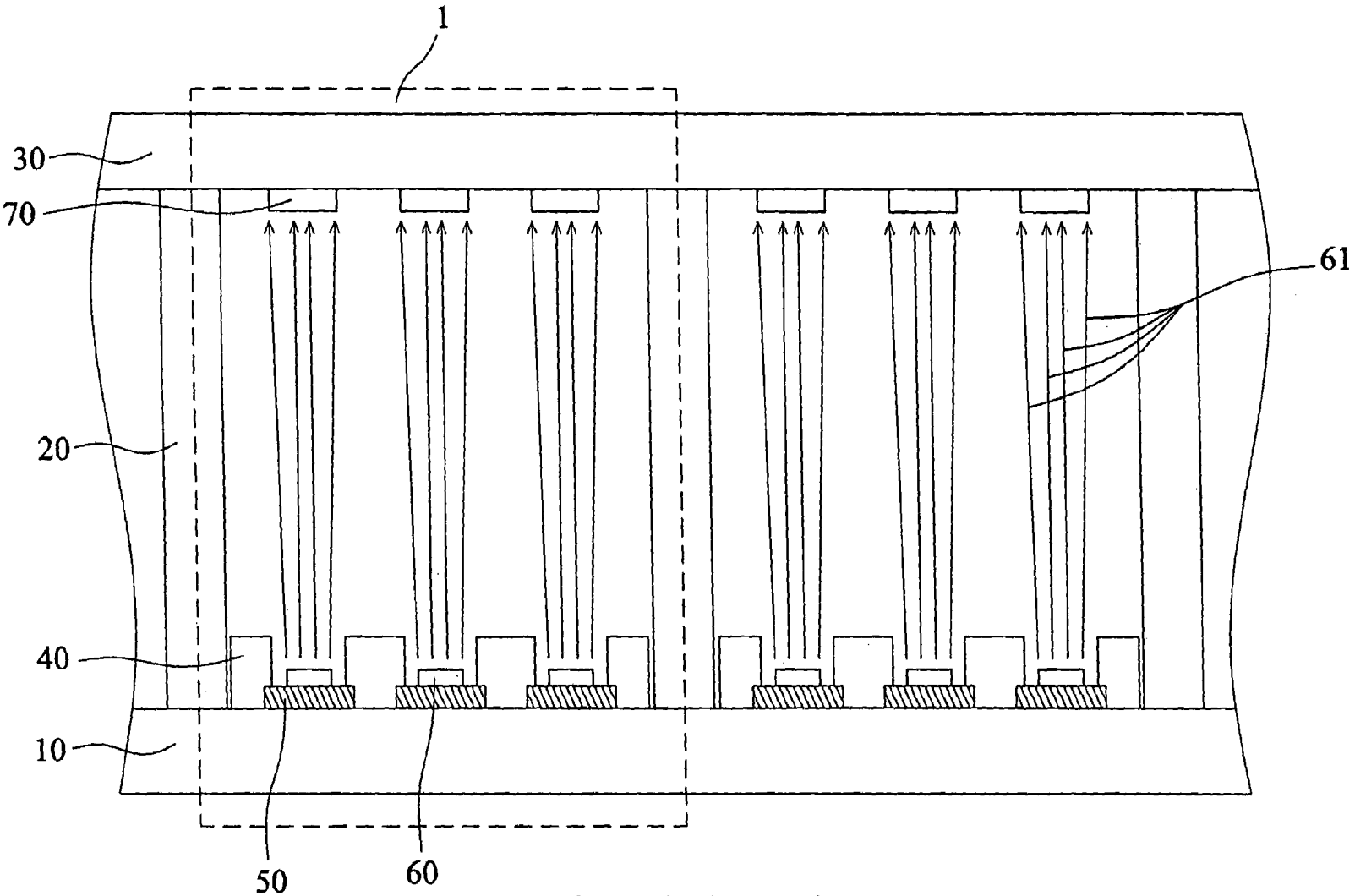
Fig. 1 (Prior Art)
FIG. 1 is a perspective diagram of a prior art field emission display unit.
Figure 2:
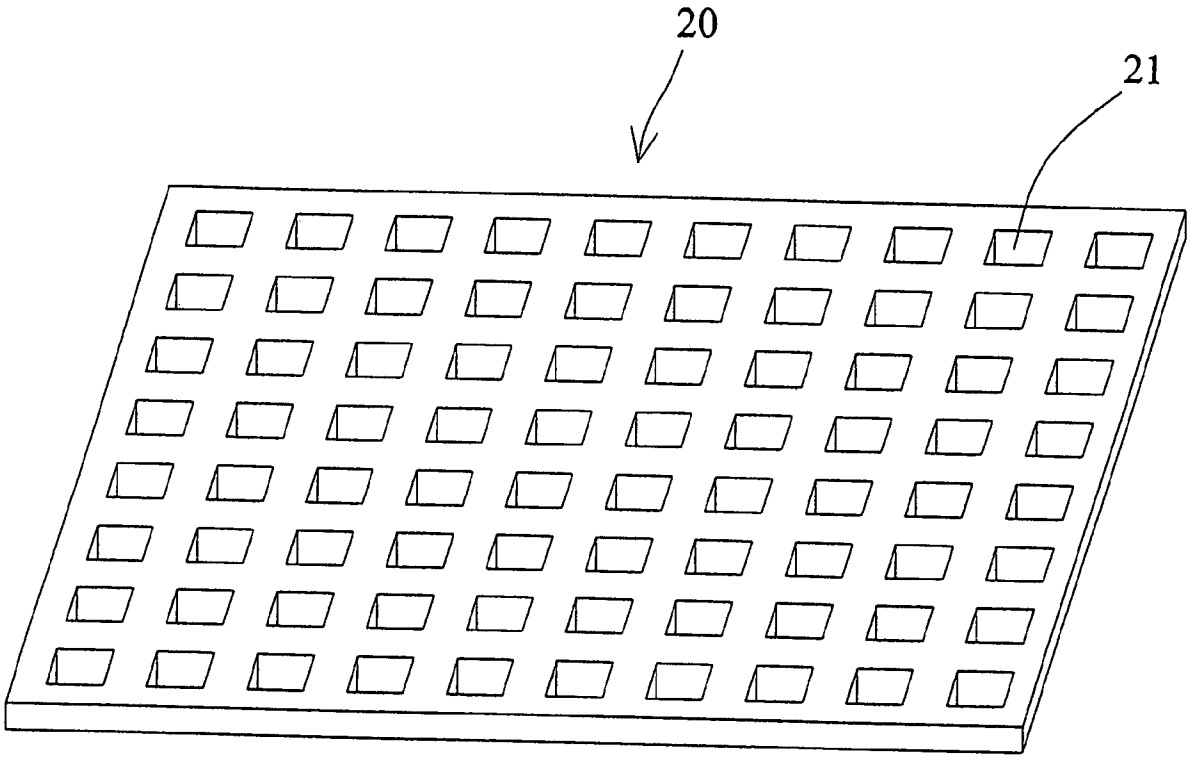
Fig. 2 (Prior Art)
FIG. 2 is a perspective diagram of a prior art supporting spacer structure.
Figure 3:
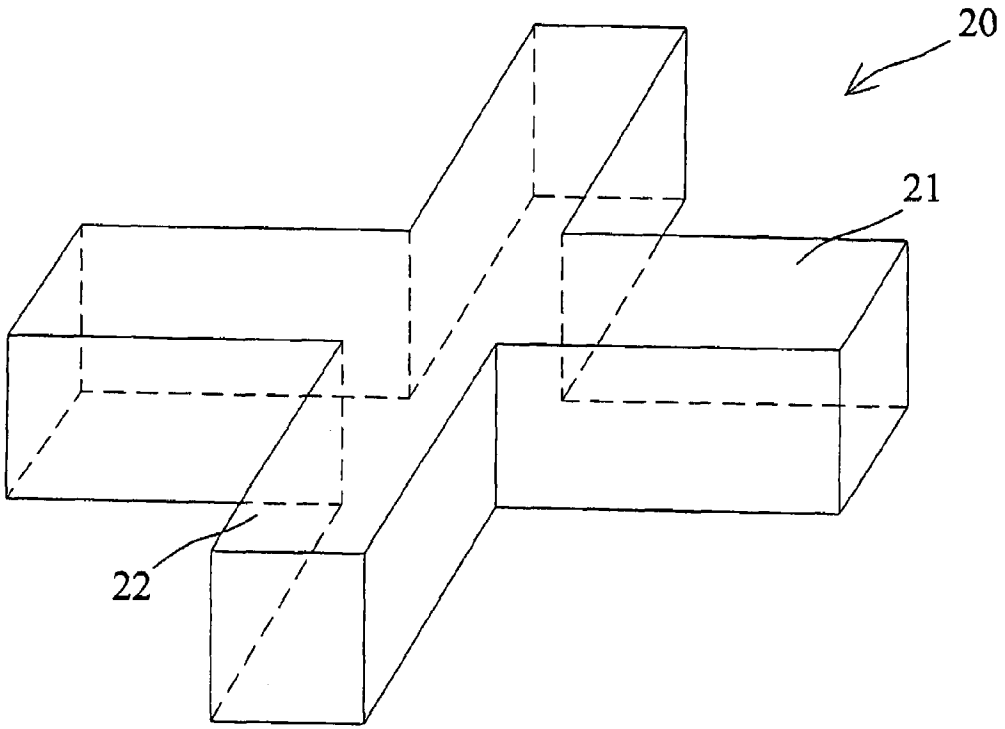
FIG. 3 is a perspective diagram of a supporting spacer structure according to an embodiment of the present invention.

Please refer to FIG. 3. FIG. 3 is a perspective diagram of a supporting spacer structure according to an embodiment of the present invention. As shown in FIG. 3, a supporting spacer 20 is cross-shaped. This supporting spacer 20 comprises a supporting unit 22 with a rectangle-shaped structure, and two clipping units 21 are extended from the middle place of the supporting unit 22. The height of the supporting spacer 20 is about 0.08~0.1 centimeters, the length of the two extended clipping units 21 is about 0.06~0.2 centimeters and the thickness is about 50~100 micrometers. Therefore, the preciseness is sufficient to achieve the requirement of high resolution for the field emission display, and the employed material is glass, ceramics or metal so that the hardness of the material is capable of satisfying the need for supporting the field emission display.

Figure 4:
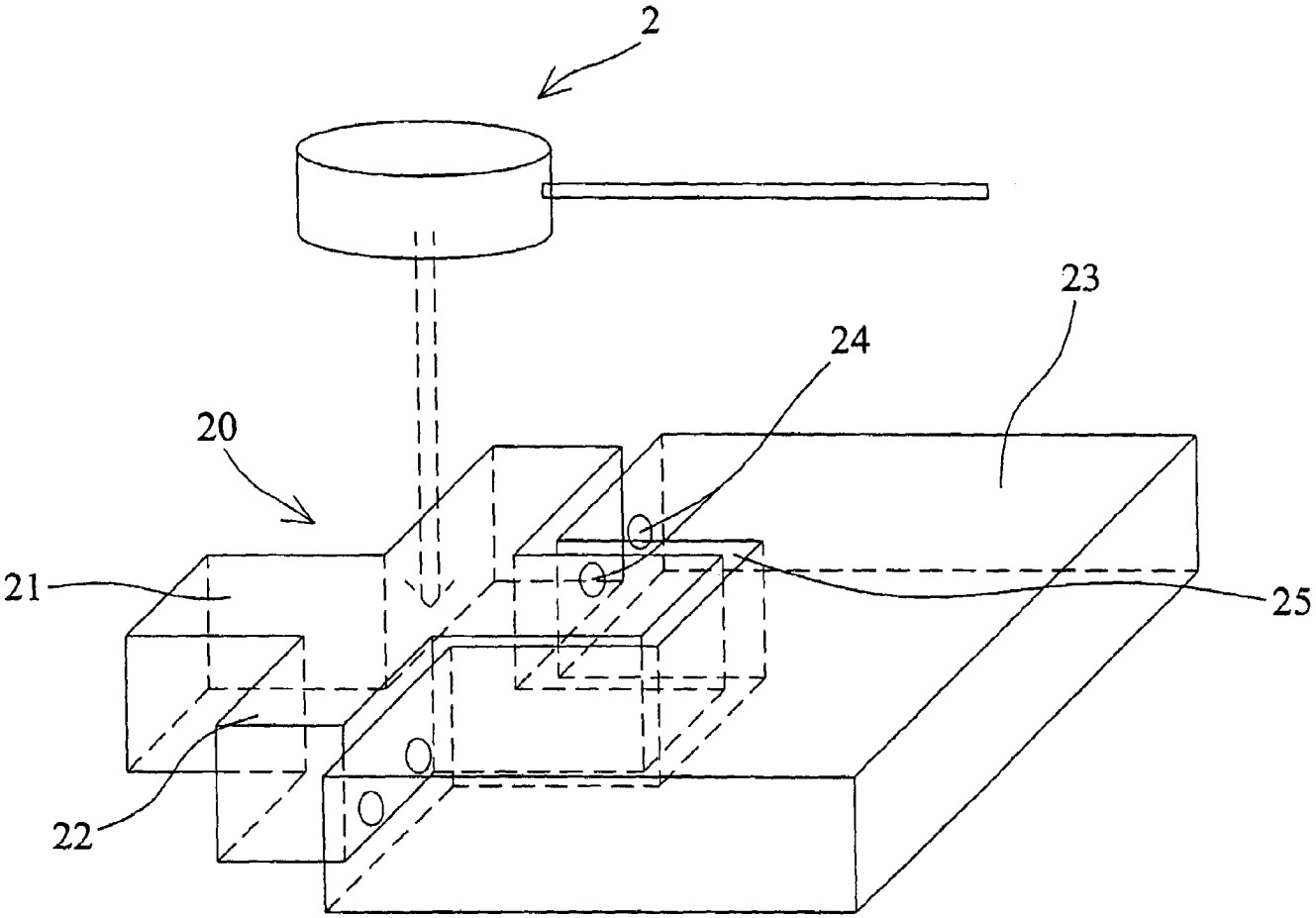
FIG. 4 is a perspective diagram of a mounting structure according to an embodiment of the present invention.

Please refer to FIG. 4. FIG. 4 is a perspective diagram of a mounting structure according to an embodiment of the present invention. A clipping arm 23 having a positioning slot 25 is used as a pre-aligner structure with a spacer, and therefore, when performing the operation of positioning the supporting spacer 20, one clipping unit 21 of the supporting spacer 20 is embedded into the positioning slot 25. Furthermore, the clipping arm 23 comprises a plurality of adsorption openings 24 which are installed on the same side surface of the positioning slot 25. Thus, when the operation of absorbing the supporting spacer 20 by using the clipping arm 23 is performed, the plurality of the adsorption openings 24 on the clipping arm 23 and on the same side surface of the positioning slot 25 will adsorb the supporting spacer 20 and move it to the required position in each of the display units of the field emission display.

In addition, in the present invention, a CCD lens 2 composed of charge coupling elements is employed for real time monitoring when the clipping arm 23 is moving and positioning the supporting spacer 20. Therefore, the precise position-aligning can be achieved when the clipping arm 23 positioning the supporting spacer 20. Besides, a pre-position-aligning function can be obtained for making the operation more precise and efficient.

Figure 5:
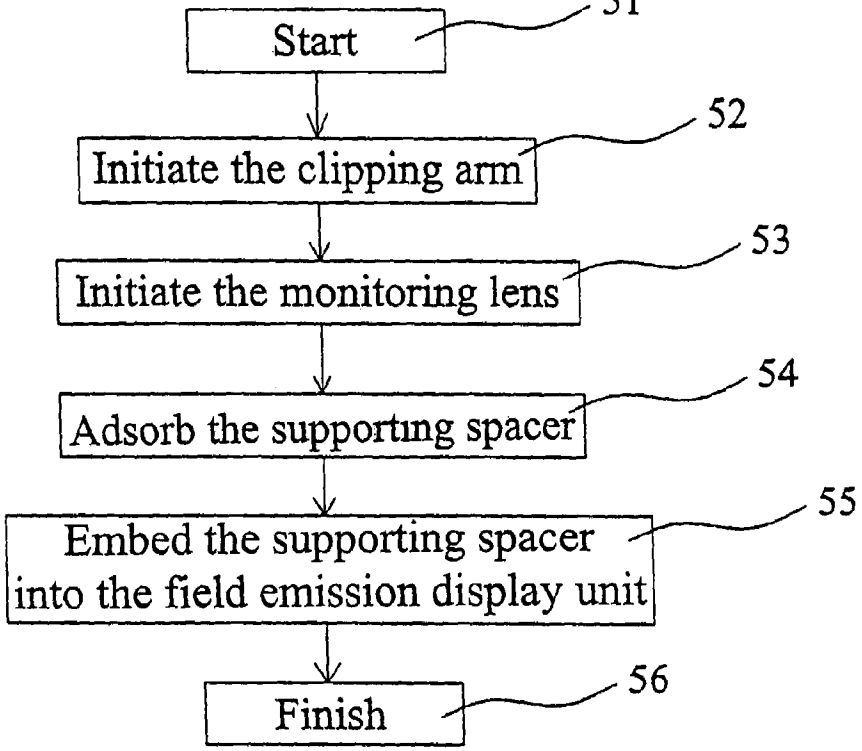
FIG. 5 is a flowchart of the steps operated in the embodiment of the present invention.

Please refer to FIG. 5. FIG. 5 is a flowchart of the steps operated in the embodiment of the present invention. When the clipping arm performs the operation of positioning the supporting spacer, after the starting (step 51), the clipping arm will be initiated (step 52) and the vacuum process will be performed on the adsorption openings of the clipping arm, and the clipping arm will be moved. Then, in the step 53, the monitoring lens 53 is initiated for monitoring the process of positioning the supporting spacer by the clipping arm. When the clipping arm adsorbs the supporting spacer in the step 54, the supporting spacer is embedded into the positioning slot and the plurality of the adsorption openings on the same side surface will adsorb the supporting spacer. Then, when the clipping arm moves the supporting spacer and puts it into each of the field emission display units (step 55), the monitoring lens will monitor the entire process of precise positioning so as to accomplish the operation of positioning the supporting spacer (step 56). For the design of preliminary position-aligning slot, the clipping arm does not have to perform the position-aligning of the rotation angle during the operation of positioning.

The above is the description of the supporting spacer clipping structure for the field emission display according to the present invention. In the practical application, the inventive supporting spacer is a rectangle-shaped structure or a cross-shaped structure where an extending arm is installed on the rectangle-shaped structure to be clipped by the clipping arm for positioning. In addition, because the clipping arm clips the supporting spacer by the plurality of adsorption openings, the adsorption openings adsorb the supporting spacer by vacuum-adsorption. Therefore, compared with the prior art, the supporting spacer will not be damaged by the mechanical stress. Because one field emission display has many field emission display units, the monitoring lens of the invention further performs a process of pre-position-aligning so as to promote the efficiency of positioning supporting spacer, and the monitoring lens will monitor the entire process so as to make it efficient to position the supporting spacer in the required place.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A supporting spacer mounting method for a field emission display comprising:

starting;

initiating a clipping arm, vacuum-processing an adsorption opening on the clipping arm, and moving the clipping arm;

initiating a monitoring lens while initiating the clipping arm, to monitor the process of the operation;

adsorbing a supporting spacer, moving the clipping arm to the supporting spacer, and performing a preliminary position-aligning by using a positioning slot, and adsorbing the supporting spacer by using a plurality of adsorption openings installed on the positioning slot;

embedding a field emission display unit by the clipping arm adsorbing the supporting spacer and moving to the field emission display unit, and the monitoring lens being used for embedding the supporting spacer into the field emission display unit; and finishing.

2. The supporting spacer mounting method for the field emission display of claim 1, wherein the supporting spacer employed in the step of adsorbing the supporting spacer is cross-shaped and made of glass, ceramics or metal.

3. The supporting spacer mounting method for the field emission display of claim 1, wherein in the step of embedding the field emission display unit, a field emission display is composed of a plurality of field emission display units.

4. The supporting spacer mounting method for the field emission display of claim 1, wherein in the step of adsorbing the supporting spacer, the employed supporting spacer has a cross-shaped structure or having at least one joining seam.

5. The supporting spacer mounting method for the field emission display of claim 1, wherein in the step of embedding the field emission display unit, a positioning slot is used for positioning one clipping unit of the supporting spacer in the process of the clipping arm adsorbing the supporting spacer.

6. The supporting spacer mounting method for the field emission display of claim 1, wherein in the step of embedding the field emission display unit, the employed clipping arm comprises a plurality of adsorption openings installed on it, and the plurality of the adsorption openings are positioned on the same side surface of the positioning slot, and the plurality of the adsorption openings are used for vacuum-absorbing the side surfaces of the supporting units on the supporting spacer.

7. The supporting spacer mounting for the field emission display of claim 1, wherein in the step of embedding the field emission display unit, the monitoring lens is used for monitoring the positioning of the supporting spacer in the field emission display unit performed by the clipping arm.

* * * * *